United States Patent [19]

Okada

[11] Patent Number: 4,748,053

[45] Date of Patent: May 31, 1988

[54] METHOD OF FORMING A UNIFORM RESIST FILM BY SELECTING A DURATION OF ROTATION

[75] Inventor: Masato Okada, Tokyo, Japan

[73] Assignee: Hoya Corporation, Tokyo, Japan

[21] Appl. No.: 679,317

[22] Filed: Dec. 7, 1984

[30] Foreign Application Priority Data

Dec. 8, 1983 [JP] Japan ..... 58-231933

[51] Int. Cl.[4] ..... B05D 3/12

[52] U.S. Cl. ..... 427/240; 427/385.5; 430/270; 430/935

[58] Field of Search ..... 427/240, 385.5; 430/270, 935

[56] References Cited

U.S. PATENT DOCUMENTS 4,113,492 9/1978 Sato et al. ..... 427/240
4,267,212 5/1981 Sakawaki ..... 427/240

FOREIGN PATENT DOCUMENTS 0047999 9/1963 Japan ..... 427/240
0026214 2/1977 Japan ..... 427/240
57-050573 3/1982 Japan ..... 427/240

*Primary Examiner*—Janyce A. Bell
*Attorney, Agent, or Firm*—Roberts, Spiecens & Cohen

[57] ABSTRACT

In a method of coating a substrate with a resist film, the substrate is rotated at a first speed of rotation, and a duration of rotation, and a multiplication product between the first speed and the rotation in consideration of a desired thickness after a resist is dropped on the substrate. The resist is uniformly spread on the substrate to form a wide uniform area because uniformity of the resist depends not only on the first speed but also on the duration and the multiplication product. After elapse of the duration of rotation, the spread resist is dried to form the resist film by rotating the substrate at a second speed slower than the first speed. The first speed is selected between 100 (rpm) and 6,000 (rpm) while the duration and the multiplication product do not exceed 20 (sec) and 24,000 (rpm.sec), respectively. The second speed is not faster than 130 (rpm).

8 Claims, 1 Drawing Sheet

METHOD OF FORMING A UNIFORM RESIST FILM BY SELECTING A DURATION OF ROTATION

BACKGROUND OF THE INVENTION

This invention relates to a method of coating a substrate with a resist, such as a photoresist, an electron beam resist, or the like to manufacture an article which can be processed into a reticle, a mask, or the like.

A reticle and a photo-mask are indispensable with large scale integration or very large scale integration. Such a reticle or a mask is manufactured by delineating a pattern on a substrate, such as a mask blank, by the use of a lithography technique. Before delineating such a pattern, the mask blank should be coated with a resist film. It is troublesome for each customer to coat the mask blank with the resist film. Accordingly, the customer's demands have been recently directed to an article having the resist film coated on the substrate.

The substrate may be either circular or square in shape. At any rate, the resist film should uniformly be coated irrespective of the shape of the substrate.

A conventional method is implemented by the use of a spin coater, as will later be described with reference to one figure of the accompanying drawing. More particularly, the resist is dripped on the substrate supported on a rotatable chuck of the spin coater. The substrate is thereafter rotated or spun together with the chuck. As a result, the resist is spread or expanded on the substrate to form the resist film on the substrate. When the resist spreads on the substrate, an interference color visibly appears and moves from a central portion of the substrate to a peripheral portion thereof. Such a movement of the interference color stops when the resist is dried into the resist film. In addition, the thickness of the resist film is dependent on the speed of rotation of the substrate.

Under the circumstances, the conventional method forms the resist film to a desired thickness by controlling the speed of rotation and by observing the movement of the interference color. The speed of rotation is invariable in the conventional method until the movement of the interference color stops on the substrate.

However, the resist film inevitably becomes nonuniform in thickness with the conventional method. Especially, such nonuniformity becomes serious when the substrate is square in shape.

Alternatively, another coating method is proposed by K. Shibata in Japanese Unexamined Patent Publication No. Syô 58-207,631, namely, 207,631/1983. The proposed method can form a uniform resist film on a circular substrate by the use of the spin coater. Specifically, the speed of rotation of the substrate is varied at a first, a second, and a third step which serve for spreading the resist on the substrate, for expelling a superfluous amount of the resist from the substrate, and for stabilizing the resist into the resist film, respectively. The speed of rotation is faster during the second step than the third step.

However, the resist film also becomes nonuniform in thickness with the proposed method when the substrate is square in shape.

SUMMARY OF THE INVENTION

It is an object of this invention to provide a resist coating method which can coat a substrate with a uniform resist layer.

It is another object of this invention to provide a resist coating method of the type described, which is suitable for a square-shaped substrate.

It is still another object of this invention to provide an article manufactured by the above-mentioned method.

A method to which this invention is applicable is for forming a resist film on a substrate to a predetermined thickness by dropping a predetermined resist onto the substrate and thereafter rotating the substrate. According to this invention, the method comprises the step of selecting a first speed of rotation of the substrate, a duration of the rotation, and a multiplication product of the first speed and the duration. The first speed, the duration, and the product are selected in consideration of the predetermined thickness. The method further comprises the steps of spreading the resist dropped on the substrate by rotating the substrate at the first speed for the selected duration, and drying the resist spread during the spreading step into the resist film by rotating the substrate at a second speed which is slower than the first speed.

DESCRIPTION OF THE PREFERRED EMBODIMENTS

Figure 1:
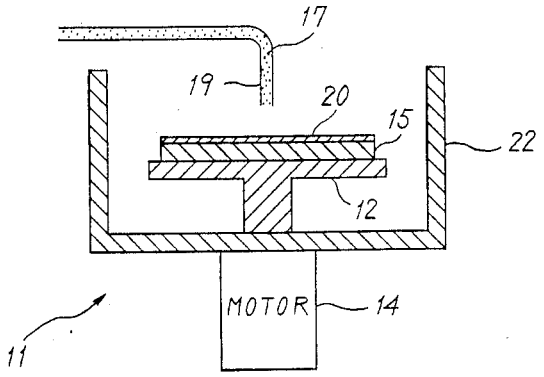
FIG. 1 is a schematic sectional view of a spin coater for use in a method according to this invention and a conventional method.
Figure 2:
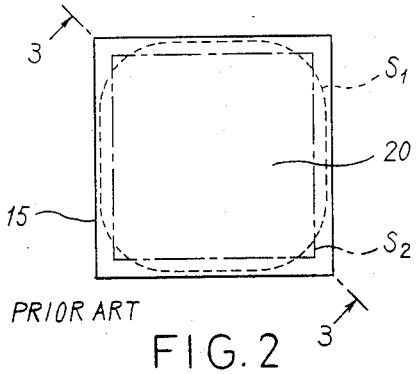
PRIOR ART FIG. 2
FIG. 2 is a top view of an article manufactured by the conventional method.
Figure 3:
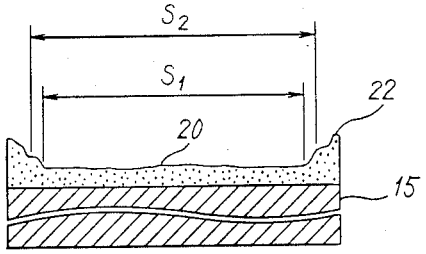
PRIOR ART FIG. 3
FIG. 3 is a sectional view taken along a line 3—3 in FIG. 2.

Referring to FIGS. 1 through 3, a conventional method will be described for a better understanding of this invention and is substantially equivalent to that described in the background of the instant specification. The method is carried out by the use of a spin coater 11 as illustrated in FIG. 1. The spin coater 11 comprises a rotatable chuck 12 having a supporting surface which is directed upwards in FIG. 1 and a motor 14 for rotating the chuck 12. A substrate 15 is supported on the supporting surface and may be a photomask blank comprising a transparent plate and an opaque thin film covering the transparent plate. A photoresist 17 is dripped on the thin film from a nozzle 9 and it spreads on the substrate 15 in the course of rotation of the substrate 15 to form a photoresist film or layer 20. Such a substrate with the photoresist film 20 is called an article.

During rotation of the substrate 15, superfluous photoresist may be scattered outside the substrate 15. The chuck 12 and the substrate 20 are placed inside a cup 22 to avoid undesired contamination resulting from scattering of the superfluous photoresist.

In the interim, the thickness of the photoresist film 20 is dependent on the speed of rotation of the substrate 15, namely, the chuck 12. This means that the thickness of the photoresist film 20 can be adjusted to a desired thickness by controlling the speed of rotation of the substrate 15. Taking the above into consideration, the photoresist 17 is spread on the substrate 15 by rotating the substrate 15 after the photoresist 17 is dripped.

When the photoresist 17 is spread on the substrate 15, an interference color appears on the spread photoresist and moves from a central portion of the substrate 15 to a peripheral portion thereof, as mentioned in the background of the instant specification. Such movement is continued until the spread photoresist is dried to form the photoresist film 20. Therefore, the substrate 15 is rotated until the movement of the interference color is stopped.

It is preferable that the photoresist film 20 be uniform in thickness to delineate a fine pattern on the photoresist film 20 into a reticle of a photomask. In general, such an article has an effective or usable area of the photoresist film 20. The thickness of the photoresist film 20 should be uniform at least in the effective area. A recent demand is to widen the effective area on each of circular and square substrates.

However, it is difficult to make the photoresist film widely uniform in thickness when the substrate 15 is square.

Referring to FIGS. 2 and 3 together with FIG. 1, the photoresist film 20 is formed on the substrate 15 of a square shape with the conventional method and becomes thick at the four corners of the substrate 15, as illustrated in FIGS. 2 and 3, because the photoresist is gathered and heaped up into masses 22 of photoresist at the four corners during rotation of the substrate 15. As a result, the photoresist film 20 becomes substantially uniform in a substantially circular area (indicated at $S_1$) surrounded by a broken line in FIG. 2. On the other hand, the effective area is expanded to an area (indicated at $S_2$) defined by a dot-and-dash line. From this fact, it is readily understood that the effective area $S_2$ is extended outside of the uniform and circular area $S_1$ at the four corners.

The uniform area $S_1$ may be expanded by raising the speed of rotation to a high speed such that the masses 22 of photoresist are expelled from the four corners. However, the photoresist film 20 becomes extremely thin in comparison with the desired thickness when the substrate is rotated at such a high speed.

Figure 4:
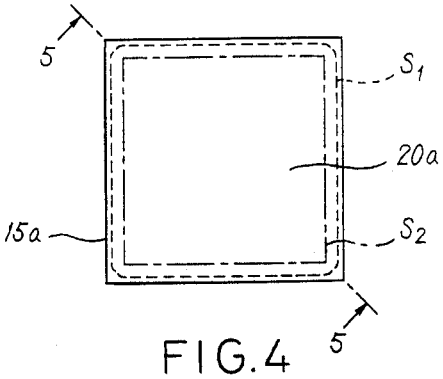
FIG. 4 is a top view of an article manufactured by the method according to this invention.
Figure 5:
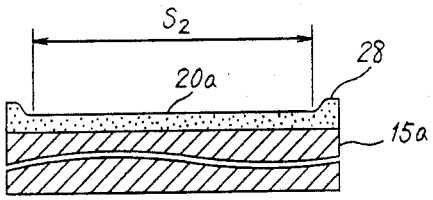
FIG. 5 is a sectional view taken along line 5—5 in FIG. 4.

Referring to FIGS. 4 and 5, the method according to this invention can be implemented by the use of the spin coater 11 illustrated in FIG. 1 and can coat a substrate (depicted at 15*a* in FIGS. 4 and 5) with a uniform resist film (depicted at 20*a*) of a desired thickness over a wide area. Therefore, it is possible with this method to widen the effective area of the resist film 20*a*.

According to the inventor's experimental studies, it has been found that the thickness of a resist film is dependent not only on the speed of rotation but also on the duration of rotation and that uniformity of the resist film is dependent on the speed, the duration, and the multiplication product of the speed of rotation and the duration of rotation. Specifically, the uniformity of the resist film is degraded when the duration of rotation and the mutliplication product exceed 20 seconds and 24,000 (rpm.sec) which will be called a first and a second critical value, respectively.

Thus, the speed of rotation, the duration of rotation, and the multiplication product therebetween should be selected in consideration of the desired thickness of the resist film on the condition that the duration and the product do not exceed the first and the second critical values. The selected speed of rotation may be referred to as a first speed of rotation for convenience of description.

Selection is also made of a second speed of rotation which is slower than the first speed of rotation and which is preferably equal to or less than 130 (rpm).

In addition, viscosity and an amount of the resist are selected in consideration of the desired thickness, as known in the art. In the example being illustrated, the viscosity and the amount of the resist are assumed to be invariable.

Under the circumstances, the resist is dripped on the substrate 15*a* as in FIG. 1. The substrate 15*a* may be rotated at another speed of rotation slower than the first speed of rotation before the resist is dripped.

Thereafter, a spreading step is carried out to spread the dripped resist. During the spreading step, the substrate 15*a* is rotated at the first speed of rotation for a duration determined in relation to the multiplication product. As a result, the resist is spread on the substrate 15*a* to form a spread resist.

In FIGS. 4 and 5, the illustrated substrate 15*a* has a square shape of, for example, 127 mm×127 mm and an effective area $S_2$ of, for example, 107 mm×107 mm. During the above-mentioned spreading step, the resist is spread or expanded to an area $S_1$ which is surrounded by a broken line. The resist is substantially uniform in thickness within the area $S_1$ which may therefore be called a uniform area. As illustrated in FIG. 4, the uniform area $S_1$ becomes wider than the effective area $S_2$ by carrying out the above-mentioned spreading step. In other words, a nonuniform area is formed on a restricted portion close to an edge of the substrate 15*a*.

Description will now be made concerning why such a wide uniform area $S_1$ can be formed by the spreading step. At first, let the duration of rotation become longer than 20 seconds or the multiplication product become greater than 24,000 (rpm.sec). In this event, it has been observed that the nonuniform area of the resist inversely progresses from a peripheral area of the substrate 15*a* towards a central portion thereof. Such progress of the nonuniform area degrades the uniformity of the resist.

In addition, the first speed of rotation should be selected between 100 (rpm) and 6,000 (rpm) even when the multiplication product does not exceed the second critical value of 24,000 (rpm.sec). If the first speed of rotation is a low speed of rotation lower than 100 (rpm), the resist is not sufficiently spread towards a peripheral region of the substrate 15*a* and uniformity of the resist film 20*a* is deteriorated. On the other hand, safety of the spin coater is not assured when the first speed of rotation exceeds 6,000 (rpm). Preferably, the first speed of rotation is between 250 (rpm) and 2,000 (rpm), both inclusive.

At any rate, the resist is substantially uniform at least in the effective area $S_2$ by rotating the substrate 15*a* in the above-mentioned manner.

The spreading step is continually followed by a drying step of drying the expanded resist to form the resist film 20*a*. During the drying step, the substrate 15*a* is rotated at the second speed of rotation slower than the first speed of rotation. Under the circumstances, the resist never flows on the substrate 15*a* during the drying step. As a result, the resist film 20*a* remains on the substrate 15*a* as illustrated in FIGS. 4 and 5 and is kept at the desired thickness in the area $S_1$ wider than the effective area $S_2$. This means that the illustrated area has a wide effective area as compared with that illustrated in FIGS. 2 and 3.

First Embodiment

The above-mentioned coating method was carried out to coat a substrate with a positive electron beam resist of poly-butene-1-sulfone. The substrate 15a comprised a transparent glass plate and a chromium film covered on the glass plate as a shading film. Such a substrate serves as a mask blank. The substrate 15a had a size of 127 mm×127 mm. The substrate 15a was fixed to the chuck 12 illustrated in FIG. 1. The above mentioned electron-beam resist was dripped on the substrate 15a. In this event, it is possible to adjust the viscosity of the electron beam (EB) resist by the use of a solvent which may be, for example, methyl cellosolve acetate. In the example being illustrated, the viscosity was equal to 30 (cP). In addition, the resist had a vapor pressure of 2 mmHg at a temperature of 20° C.

Let the desired thickness of the (EB) resist film 20a be 4,000 angstroms. In order to attain the desired thickness of 4,000 angstroms, the first speed of rotation and the duration of rotation were selected at 960 (rpm) and 14 (seconds), respectively. It is to be noted here that the multiplication product of the first speed and the duration is equal to 13,440 and does not exceed the second critical number of 24,000 (rpm.sec). The duration was measured after the speed of rotation reached the first speed of 960 (rpm).

The resist was expanded or spread on the substrate 15a, as illustrated in FIGS. 4 and 5, in the spreading step to the uniform area $S_1$. The masses of the resist were heaped up only at the four corners of the substrate 15a.

The effective area $S_2$ was equal to 107 mm×107 mm and is included in the uniform area $S_1$. Accordingly, the effective area $S_2$ was uniform in thickness.

After a duration of 14 seconds, the drying step was carried out for a duration of 160 seconds at the second speed of rotation of 50 (rpm) in the example. During the drying step, the resist was dried into the resist film 20a.

As suggested before, the thickness of a resist layer is variable depending on both the first speed of rotation and the duration of rotation. Therefore, the duration of rotation should be varied when the first speed of rotation is changed from one to another. The duration and the multiplication product should not exceed 20 seconds and 24,000 (rpm.sec), respectively, as mentioned before.

The resist film 20a was measured in the effective area by the use of a thickness gage manufactured and sold by International Business Machines Corporation as IBM 7840 FTA. As a result of measurement, the resist film 20a had an average value of 4,010 angstroms, a maximum value of 4,070 angstroms, and a minimum value of 3,980 angstroms. The difference between the maximum and the minimum values was equal to 90 angstroms. Thus, the resist film 20a is substantially equal to the desired thickness in the effective area $S_2$.

For reference, Example 1 was carried out by the conventional method described in the background of the instant specification. In the conventional method, the above-mentioned resist was coated on a substrate by rotating the substrate at a speed of 1000 (rpm) for a duration of 70 seconds. The resultant resist film had an average value of 3,930 angstroms, a maximum value of 4,780 angstroms, and a minimum value of 3,810 angstroms, as shown in Table 1, when the resist layer was measured in the effective area by the above-mentioned thickness gage.

TABLE 1

| | Average (Å) | Maximum (Å) | Minimum (Å) |
|---|---|---|---|
| First Embodiment | 4,010 | 4,070 | 3,980 |
| Example 1 | 3,930 | 4,780 | 3,810 |

Inasmuch as the difference between the maximum and the minimum values is as large as 970 angstroms in reference Example 1, the resist film according to the first embodiment is considerably better in uniformity as compared with that produced by reference Example 1.

Second Embodiment

A coating method according to the second embodiment of this invention was used to coat a substrate 15a of square shape with a negative electron beam resist of poly-glycidal methacrylate. The substrate 15a was identical with that described in conjunction with the first embodiment. In this embodiment, the viscosity of the above-mentioned resist was adjusted to 15 (cP) by the use of a solvent, such as ethyl cellosolve acetate, exhibiting a vapor pressure of 1.2 mmHg at a temperature of 20° C.

The first speed of rotation and the duration of rotation were selected to form a resist film 20a having a thickness of 6,000 angstroms, on condition that the multiplication product of the first speed and the duration does not exceed 24,000 (rpm). Under the circumstances, it has been proved that the first speed of rotation and the duration of rotation were equal to 1,160 (rpm) and 6 (seconds), respectively. Thus, the product became equal to 6,960 (rpm.sec).

The substrate 15a was spun at the first speed of 1,160 (rpm) for 6 seconds after the resist was dripped on the substrate 15a. The duration was measured after the speed of rotation reached the first speed of 1,160 (rpm). In other words, the duration was exclusive of a transient time lasting until the speed of rotation reached 1,160 (rpm).

After a lapse of 6 seconds, the spreading step was succeeded by a drying step wherein the speed of rotation was reduced to the second speed of rotation. In this embodiment, the second speed was equal to 50 (rpm) as in the first embodiment. The drying step was carried out for a duration of 160 seconds to dry the spread resist to form the resist film 20a. The resist film was measured by the use of the thickness gage mentioned above and had an average value, a maximum value, and a minimum value listed on Table 2.

TABLE 2

| | Average (Å) | Maximum (Å) | Minimum (Å) |
|---|---|---|---|
| Second Embodiment | 6,160 | 6,190 | 6,140 |
| Example 2 | 6,100 | 8,320 | 5,630 |

For reference, Example 2 was carried out by the conventional method wherein a substrate was rotated or spun for a duration of 30 seconds at a speed of 3,600 (rpm) to form a resist film of 6,000 angstroms. Table 2 also shows the average, the maximum, and the minimum values of reference the resist film of Example 2.

Hereafter, the difference between the maximum and the minimum values will be considered so as to evaluate the uniformity of each of the resist layers according to the second embodiment and Example 2. The difference of the resist film 20a according to the second embodiment is equal to 50 angstroms while that of Example 2 is equal to 2,690 angstroms. Therefore, the second embodiment is remarkably improved in the uniformity of the resist layer.

Thus, it is possible with this invention to widen a uniform area of a resist film and to apply it to a substrate of square shape. An article manufactured by the method according to this invention enables delineation of a fine pattern on manufacturing a photomask from the article. Practically, it has been confirmed that the method is effective when the desired thickness of the resist film falls within a range between 2,000 angstroms and 20,000 angstroms.

While this invention has been described in conjunction with a few embodiment thereof, it will readily be possible for those skilled in the art to put this invention into practice in various other manners. For example, a photoresist may be used instead of the electron beam resist exemplified in the first and the second embodiments. The solvent may be selected for each resist. Preferably, the solvent has a vapor pressure not higher than 20 (mmHg) at the temperature of 20° C. This is because the resist is rapidly solidified at the spreading step and does not uniformly spread on the substrate. The substrate may be a display substrate comprising a transparent plate and a transparent conductive film coated thereon, a semiconductor substrate comprising a semiconductor plate and an insulating film coated thereon, and the like.

What is claimed is:

1. A method of forming a resist film on a thin film of a substrate, said method comprising the steps of:

dropping a predetermined resist onto a thin film;

spreading the resist dropped on said thin film into a spread resist to make said spread resist substantially uniform in thickness by rotating said substrate at a first speed of rotation for a first duration of time, said first speed being between 100 (rpm) and 6000 (rpm), both inclusive, and said duration of time being less than 20 (sec), such that a product obtained by multiplying the value of said first speed and said first duration of time is less than 24,000 (rpm. sec); and drying the spread resist to form the resist film of said predetermined thickness, while the thickness of the spread resist is kept substantially unchanged by rotating the substate for a second duration of time at a second speed which is lower than said first speed.

2. A method as claimed in claim 1, wherein said first speed of rotation is between 250 (rpm) and 2,000 (rpm), both inclusive.

3. A method as claimed in claim 1, wherein said second speed of rotation is not faster than 130 (rpm).

4. A method as claimed in claim 1, said resist being adjusted in viscosity by a solvent, wherein said solvent has a vapor pressure not higher than 20 (mmHg) at a temperature of 20° C.

5. A method as claimed in claim 1, wherein said substrate is circular in shape.

6. A method as claimed in claim 1, wherein said substrate is square in shape.

7. A method as claimed in claim 1, wherein said product is 13,440 (rpm. sec) by establishing said first speed and said first duration of time at 960 (rpm) and 14 (sec), respectively, while said second speed and said second duration of time are equal to 50 (rpm) and 160 (sec), respectively.

8. A method as claimed in claim 1, wherein said product is 6960 (rpm. sec) by establishing said first speed and said first duration of time at 1,160 (rpm) and 6 (sec), respectively, while said second speed and said second duration of time are equal to 50 (rpm) and 160 (sec), respectively.

* * * * *